United States Patent [19]

Castellanos

[11] Patent Number: 4,571,857

[45] Date of Patent: Feb. 25, 1986

[54] PLASTIC FOOT SUPPORT WITH REINFORCING STRUTS

[76] Inventor: Rigoberto Castellanos, 1929 W. Flagler St., Miami, Fla. 33135

[21] Appl. No.: 607,456

[22] Filed: May 7, 1984

[51] Int. Cl.[4] ..... A43B 7/22; A43B 13/40

[52] U.S. Cl. ..... 36/91; 36/44; 128/595; 128/614

[58] Field of Search ..... 36/91, 88, 44, 43, 37, 36/71; 128/614, 615, 595

[56] References Cited

U.S. PATENT DOCUMENTS

| | | | |
|---|---|---|---|
| 2,404,731 | 7/1946 | Johnson | 36/44 X |
| 2,486,653 | 11/1949 | Hukill | 128/615 |
| 2,502,774 | 4/1950 | Alianiello | 36/37 X |
| 2,856,771 | 10/1958 | Anderson | 36/44 X |
| 3,081,774 | 3/1963 | Lelyveld | 128/615 |
| 3,244,176 | 4/1966 | Neu | 128/614 X |
| 3,780,742 | 12/1973 | Madgy | 128/615 X |
| 4,232,457 | 11/1980 | Mosher | 36/44 |
| 4,485,568 | 12/1984 | Landi et al. | 36/44 |

FOREIGN PATENT DOCUMENTS

| | | | |
|---|---|---|---|
| 1511344 | 12/1967 | France | 36/43 |

*Primary Examiner*—James Kee Chi

*Attorney, Agent, or Firm*—Harvey B. Jacobson

[57] ABSTRACT

Foot supports for use in footwear are molded in polypropylene sheet and include a network of longitudinal and transverse reinforcing ribs integrally molded with the support and extending across an arch-supporting area thereof, the ribs resisting stresses on the support during wear and maintaining the shape of the support without adversely affecting its resilience. The supports can be shaped to an individual's foot by heating in boiling water.

4 Claims, 9 Drawing Figures

PLASTIC FOOT SUPPORT WITH REINFORCING STRUTS

BACKGROUND OF THE INVENTION

This invention relates to foot supports which are inlaid or otherwise incorporated in footwear to provide required support for a person having weakened or unbalanced feet, or suffering from heel spurs or other foot complaints, for example.

Inlays in the form of arch supports inserted into existing footwear are exceedingly well known. Traditionally, these were made of metal plate suitably bent to shape. With the advent of lightweight synthetic man-made materials, however, there has been a move toward such materials for use in arch supporting inlays so as to provide reduced weight and increased wearer comfort. With the lighter weight materials, however, strength and shape-retention are factors of increasing relevance.

It is an object of the present invention to provide a versatile arch supporting inlay structure for use in footwear, which is readily adaptable to suit the characteristics of individual user's feet, and which is of a lightweight synthetic plastic construction, while being of adequate strength to resist day-to-day stresses in use and comfortable to wear.

STATEMENT OF PRIOR ART

The following U.S. patents pertain to foot-supporting devices and the like, none of which, however, includes the features of the present invention.

U.S. Pat. No. 2,330,398
U.S. Pat. No. 2,767,487
U.S. Pat. No. 3,601,908
U.S. Pat. No. 3,766,669
U.S. Pat. No. 4,179,826
U.S. Pat. No. 4,188,736

SUMMARY OF THE INVENTION

A foot support in accordance with the invention is molded in a lightweight resilient plastic material, preferably polypropylene, in the form of a relatively thin sheet shaped to provide a heel area, a metatarsal area, and a raised arch-supporting area therebetween, the support being characterized by the provision of reinforcing ribs integrally molded therewith and extending at least over the arch-supporting area so as to enhance the stress resistance of the support, and maintain the shape thereof during use without adversely affecting the support's resilience. The reinforcing ribs may be designed to provide reinforcement both longitudinally and transversely to the arch-supporting area of the support, resisting collapse thereof under a user's weight. For example, the reinforcing ribs may comprise a series of spaced longitudinally extending ribs, with a pattern of criss-cross ribs between an inner pair of the longitudinal ribs, and a series of intersecting part-circular, ring-like ribs extending adjacent each edge of the support.

Foot supports of molded polypropylene incorporating reinforcing ribs in accordance with the invention may be produced in different sizes and forms to suit different pediatric complaints or conditions. For example, one form of support may comprise a continuous uncovered molded sheet of polypropylene, while another form of support, for users suffering from heel spurs, may include an opening in the heel area which is covered over by a resilient pad.

The foot supports are light in weight, and comfortable to wear, with the reinforcing ribs enhancing the strength thereof so as to effectively resist stresses occurring in every day use while maintaining the basic shape of the support without adversely affecting its resilience. Moreover, the inherent flexibility of polypropylene and its thermo-softening characteristics allow the support to be molded to fit an individual's foot, for example, by first heating the support in boiling water.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
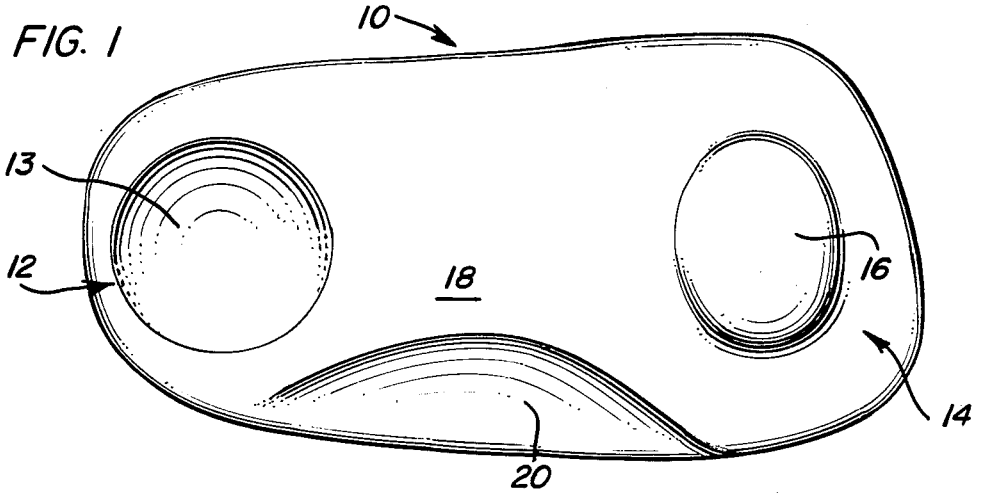
FIG. 1 is a plan view of a first form of foot support in accordance with the invention.
Figure 2:
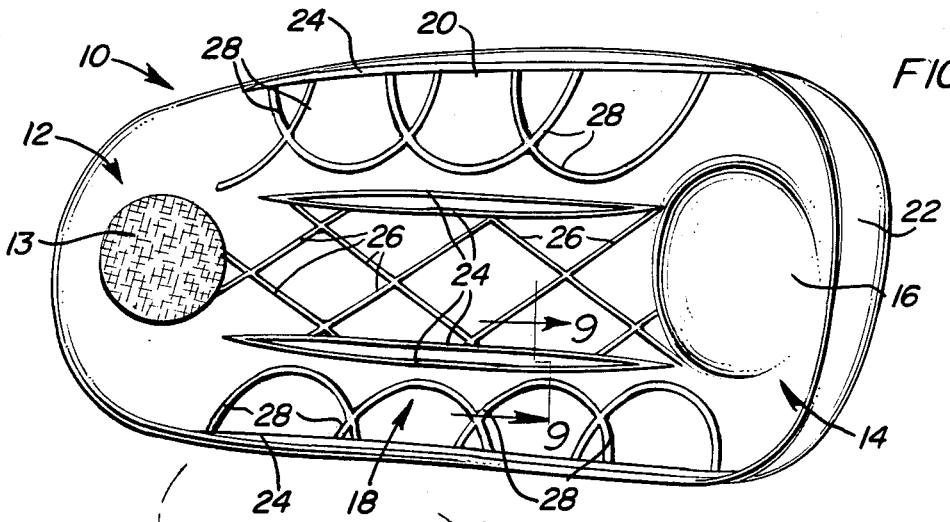
FIG. 2 is an underneath plan view of the support shown in FIG. 1.
Figure 3:
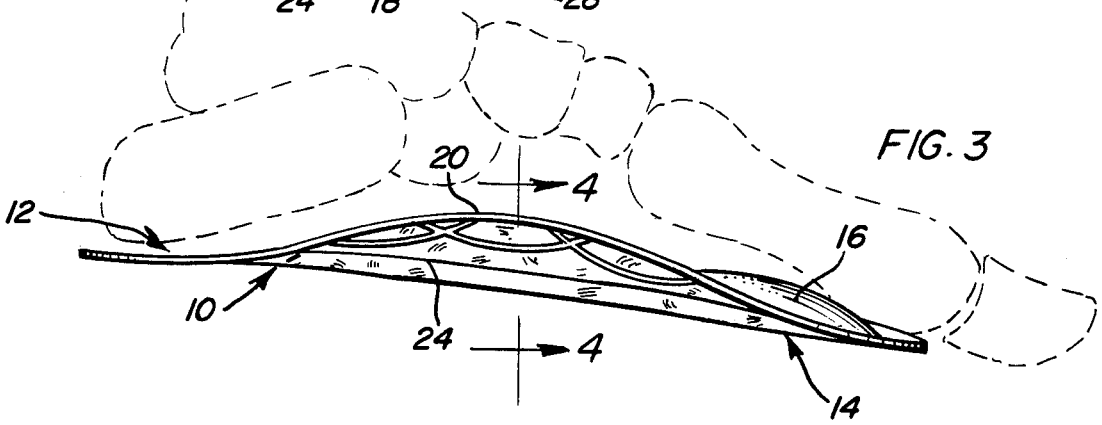
FIG. 3 is an elevational view of the support illustrating its manner of use.
Figure 4:
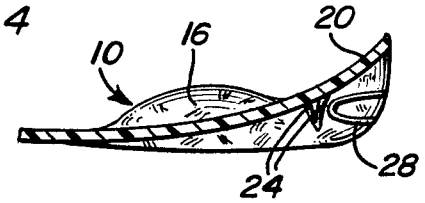
FIG. 4 is a sectional view on line 4—4 of FIG. 3.
Figure 9:
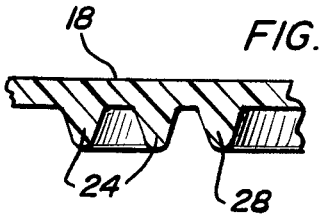
FIG. 9 is a sectional view on line 9—9 of FIG. 2.

Referring initially to FIGS. 1–4 and 9, there is illustrated a first form of foot support 10 in accordance with the invention in the form of a continuous sheet or plate of polypropylene (e.g. about ¼" in thickness) molded by any well known plastic molding technique in a shape which is generally known in foot-supporting inlays and the like.

Support 10 as illustrated is for a person's left foot and is molded to include a heel area generally indicated at 12, which may include a heel-receiving depression 13, a metatarsal area generally indicated at 14, which may include a metatarsal elevating projection 16, and an arch-supporting area 18 with a raised arch-supporting section 20 along the instep extending between and merging into the heel and metatarsal areas. The forward end of the support may be tapered as at 22 to improve comfort when the support is inserted into a wearer's shoe.

To enhance the stress resistance and shape maintaining integrity of the support, increase the general strength thereof, and resist collapse or fracture of the arch-supporting section under stresses imposed by a wearer's weight during every day use, while maintaining the inherent resilience of the support, the support includes a network of reinforcing ribs molded integrally with the support on the undersurface thereof as will now be described. Thus, as shown more particularly in FIG. 2, the ribs include longitudinal ribs 24 extending between and merging into the heel and metatarsal sections of the support, criss-cross ribs 26 extending between the innermost pair of longitudinal ribs and longitudinal series of intersecting part-circular, ring-like ribs 28 extending inwardly adjacent the respective longitudinal margins of the support between pairs of the longitudinal ribs. As shown more particularly in FIG. 9, the reinforcing ribs may have a projecting depth and thickness approximating the thickness of the support. Preferably for comfort, the ribs may terminate short or merge smoothly into peripheral areas of the support which contact an underlying insole of a wearer's shoe or the like.

Figure 5:
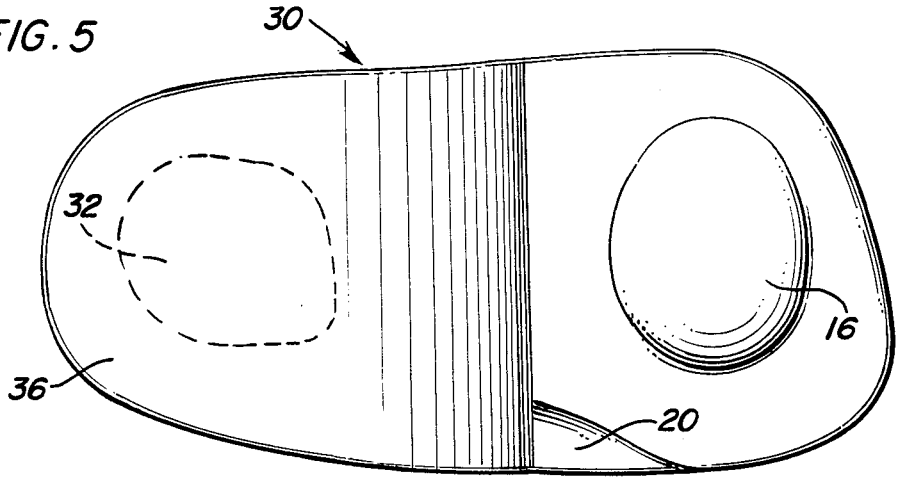
FIG. 5 is a plan view of a second form of foot support in accordance with the invention.
Figure 6:
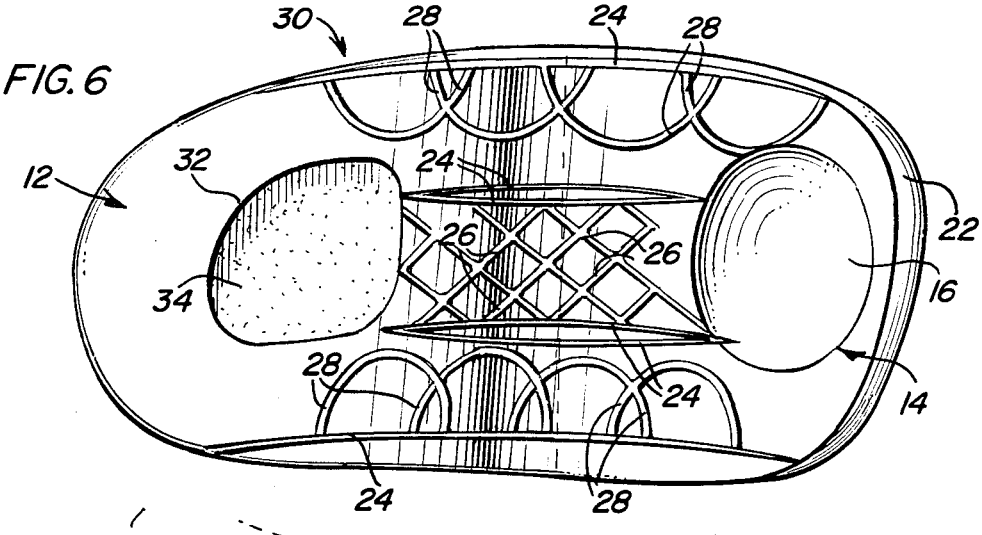
FIG. 6 is an underneath plan view of the support shown in FIG. 5.
Figure 7:
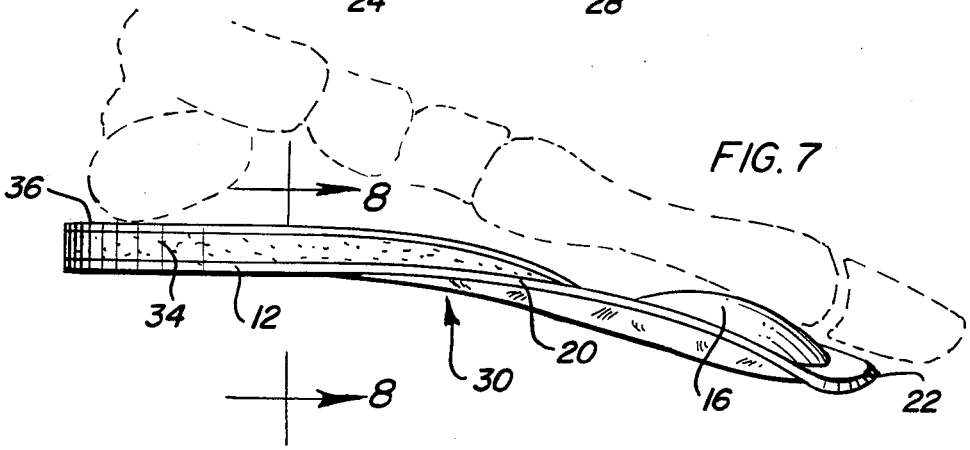
FIG. 7 is a side elevational view of the second form of support.
Figure 8:
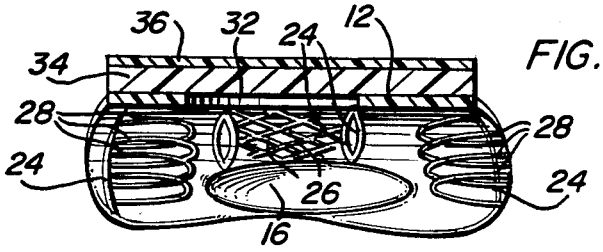
FIG. 8 is a sectional view on line 8—8 of FIG. 7.

FIGS. 5 to 8 show a modified form of foot support 30 which is similar in all respects to foot support 10 previously described, except that the molded polypropylene plate is formed with an opening 32 in the heel area which is covered by a heel pad comprising a sheet 34 of resilient padding such as foam rubber of about 3/16" thickness with a tapered front edge, and a cover sheet 36 of leather or like material. Support 30 is particularly suited to persons suffering from heel spurs.

Foot supports in accordance with the invention, which can be supplied in a range of sizes, are lightweight and flexible, comfortable to wear, and the reinforcing ribs adequately enhance the strength of the polypropylene to resist stresses occurring in day-to-day wear, without affecting the inherent resilience of the support. Further, the supports can be shaped to an extent to suit the characteristics of an individual's foot by first heating the support, e.g. by submersion in boiling water for about 5 minutes, and then manipulating to shape, including adjustment in the degree of elevation of the arch-supporting area, if required. When the support is cooled and set to shape, the reinforcing ribs serve to maintain the shape thereof during use, while the flexible resilient nature of the material allows a degree of flexure while walking, for exmaple, and a return to the set shape, so as to produce a massaging effect on the foot.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A foot support for use in an article of footwear comprising a sheet of molded polypropylene plastic shaped to fit the foot and having a heel area, a metatarsal area, and an arch area with an elevated arch-supporting section between and merging into the heel and metatarsal area, the support being formed with integral reinforcing ribs extending at least across the arch-supporting section of the arch area, wherein the ribs include longitudinal reinforcing ribs spaced from longitudinal edges of the support, criss-cross reinforcing ribs extending between the longitudinal ribs, and longitudinal series of intersecting semi-circular reinforcing ribs along the longitudinal edges of the support the ends of each semi-circular rib terminating at the respective edge of the support.

2. The invention of claim 1 wherein the heel area of the support has an opening in the molded plastic sheet and the support includes a heel pad secured on the upper surface of the sheet over the opening.

3. The invention of claim 1 wherein the support has a projection on the metatarsal area.

4. A lightweight resilient foot-supporting inlay for footwear and the like comprising a polypropylene sheet having a heel area, a metatarsal area, and an arch-supporting area between and merging into the heel area and metatarsal area, the support being formed with a network of reinforcing ribs across the arch-supporting area molded integrally with the polypropylene sheet for resisting stresses imposed on the support during wear and maintaining the shape of the support without adversely affecting the resilience thereof, wherein the ribs include longitudinal reinforcing ribs spaced from longitudinal edges of the support, criss-cross reinforcing ribs extending between the longitudinal ribs, and longitudinal series of intersecting semi-circular reinforcing ribs along the longitudinal edges of the support, and wherein the inlay is molded to fit a user's foot after heating by immersion in a heated liquid.

* * * * *